US006244009B1

(12) United States Patent
Cerrato

(10) Patent No.: US 6,244,009 B1
(45) **Date of Patent: *Jun. 12, 2001**

(54) FLEXIBLE INTERLOCKING WALL SYSTEM

(76) Inventor: Dominic Cerrato, 162 Township Highway 202, Bloomingdale, OH (US) 43190

( * ) Notice: Subject to any disclaimer, the term of this patent is extended or adjusted under 35 U.S.C. 154(b) by 0 days.

This patent is subject to a terminal disclaimer.

(21) Appl. No.: 09/290,635

(22) Filed: Apr. 12, 1999

Related U.S. Application Data

(63) Continuation-in-part of application No. 08/925,311, filed on Sep. 8, 1997, now Pat. No. 5,899,040.

(51) Int. Cl.[7] ..... E04B 5/04

(52) U.S. Cl. ..... 52/604; 52/223.7; 52/309.12; 52/405.3; 52/503; 52/590.2; 52/592.1; 52/592.6

(58) Field of Search ..... 52/604–608, 223.7, 52/503, 590.2, 590.3, 592.1, 405.3, 309.12, 592.6

(56) References Cited

U.S. PATENT DOCUMENTS

| | | | | |
|---|---|---|---|---|
| 676,803 | | 6/1901 | Shaw . | |
| 690,811 | | 1/1902 | Waller . | |
| 729,408 | | 5/1903 | Pickin . | |
| 748,603 | | 1/1904 | Henry . | |
| 859,663 | | 7/1907 | Jackson . | |
| 868,838 | | 11/1907 | Brewington . | |
| 1,242,087 | * | 10/1917 | Wadde . | |
| 1,562,728 | | 11/1925 | Albrecht . | |
| 1,684,050 | | 9/1928 | Adams . | |
| 2,902,852 | | 9/1959 | Lofstrom . | |
| 3,378,969 | | 4/1968 | Larger . | |
| 4,367,615 | * | 1/1983 | Feldman | 52/583 |
| 4,726,567 | | 2/1988 | Greenberg . | |
| 4,787,189 | * | 11/1988 | Haug et al. | 52/415 |
| 5,138,808 | | 8/1992 | Bengston et al. . | |
| 5,355,647 | | 10/1994 | Johnson et al. . | |
| 5,566,517 | * | 10/1996 | Ishii et al. | 52/387 |
| 5,685,119 | * | 11/1997 | Zschoppe | 52/592.5 |
| 5,715,635 | * | 2/1998 | Sherwood | 52/286 |
| 5,787,675 | * | 8/1998 | Futagi | 52/745.1 |
| 5,802,797 | * | 9/1998 | Storer-Folt | 52/604 |
| 5,899,040 | * | 5/1999 | Cerrato | 52/604 |
| 6,098,357 | * | 8/2000 | Franklin et al. | 52/223.7 |

FOREIGN PATENT DOCUMENTS 1293147 of 1961 (FR) .

* cited by examiner

*Primary Examiner*—Beth A. Stephan
*Assistant Examiner*—Yvonne M. Horton
(74) *Attorney, Agent, or Firm*—Robert G. Lev

(57) ABSTRACT

A masonry wall system is disclosed incorporating a plurality of courses of masonry blocks, each block consisting of interlocking dovetails 12 along with vertical an horizontal mating surfaces (11,15,16,17). The main block, has two stabilizing holes running at a vertical axis through the center. Steel reinforcement rods or square tubes are loosely inserted into these stabilizing holes (14) at predetermined intervals. Comer blocks (26) are employed to connect the walls at right angles and are so used in conjunction with short blocks (28) to staggered the vertical joints from course to course. The predetermined tolerances between the masonry components and the loosely placed rods or tubes permit the wall to have a fluid property. Forces such as settling, hydrostatic pressure and seismic disturbances are then automatically absorbed and systematically distributed across the entire wall. When all of the masonry components reach the end of their tolerance, the wall locks up as a solid interconnected mass. The force is then passed on to the stabilizing rods or tubes which now act to stabilize the wall against further movement.

15 Claims, 8 Drawing Sheets

FIG. 3
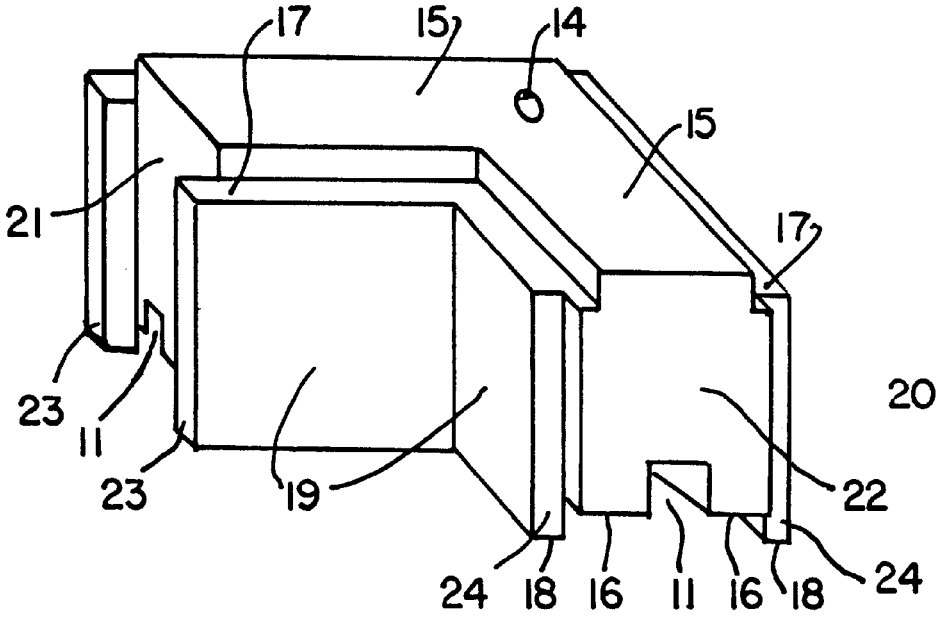
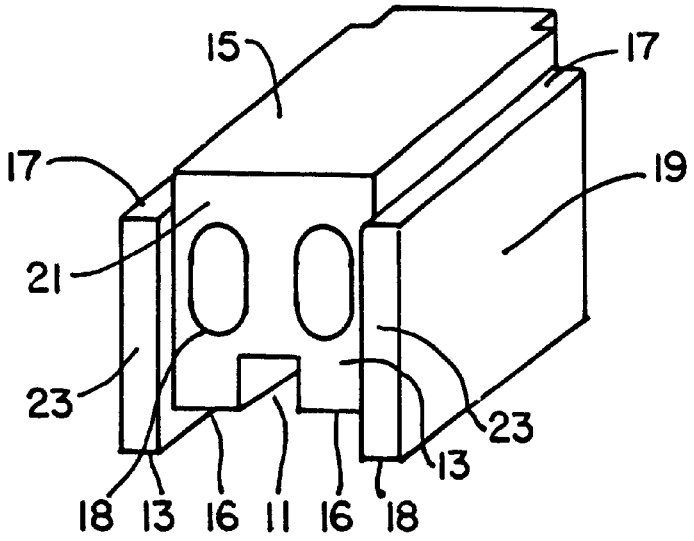
FIG. 4

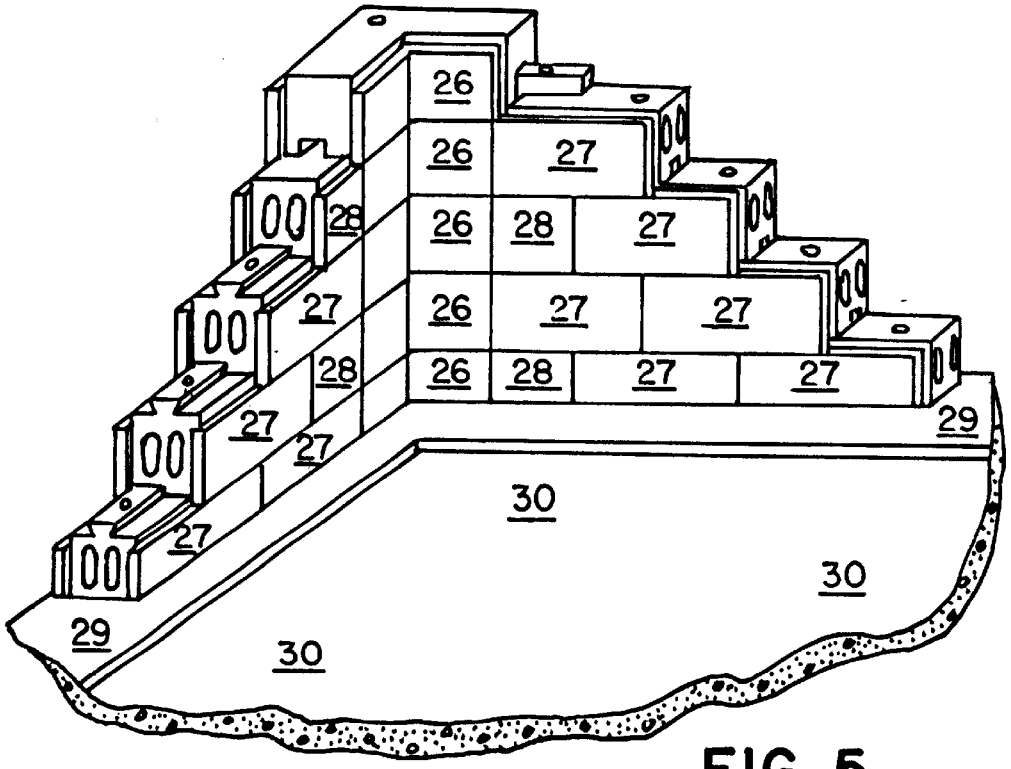
FIG. 5
FIG. 6
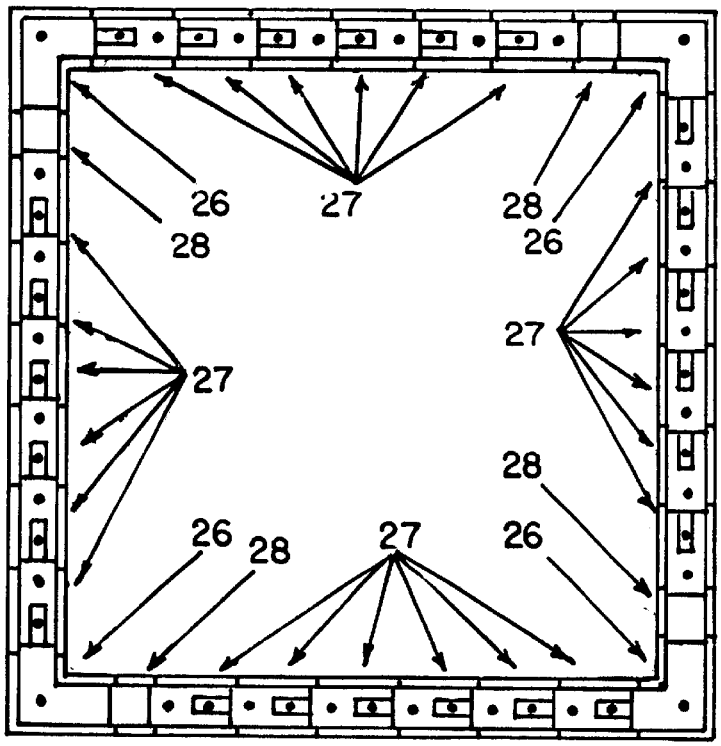

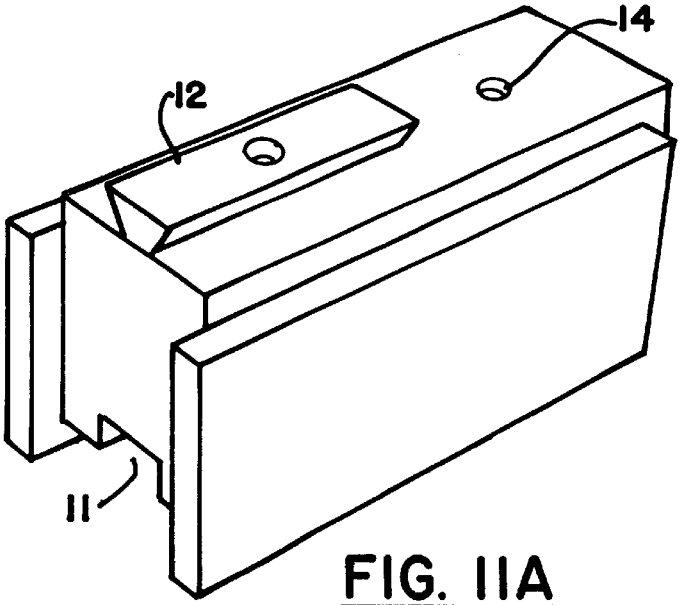
FIG. 11A
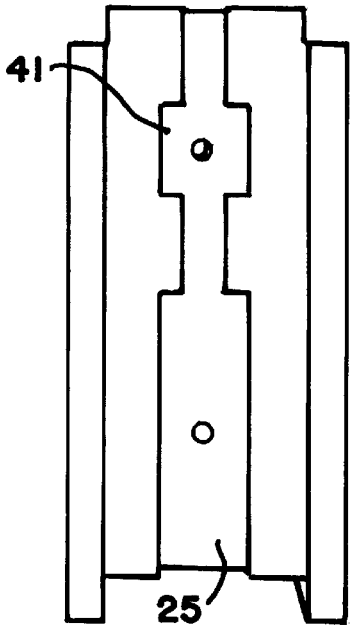
FIG. 11B
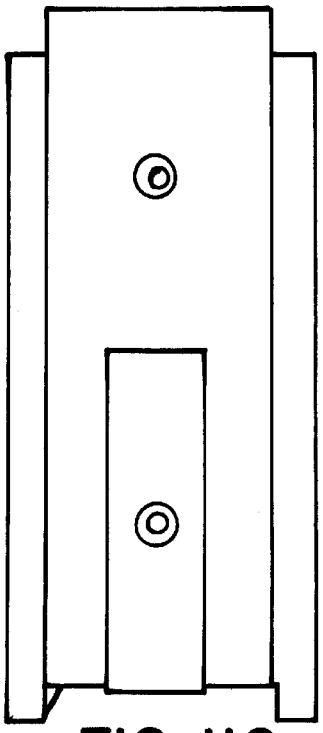
FIG. 11C
FIG. 11D
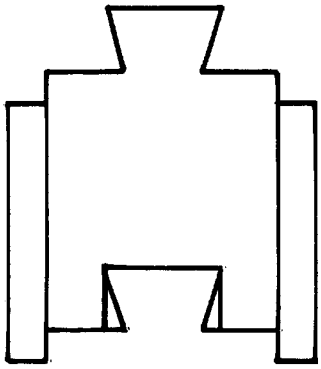
FIG. 11E
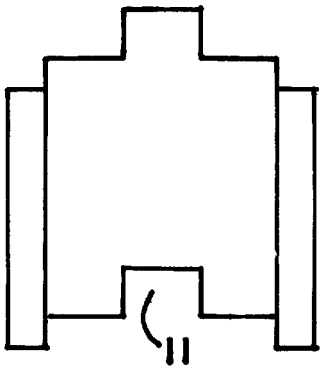

FIG. 12A
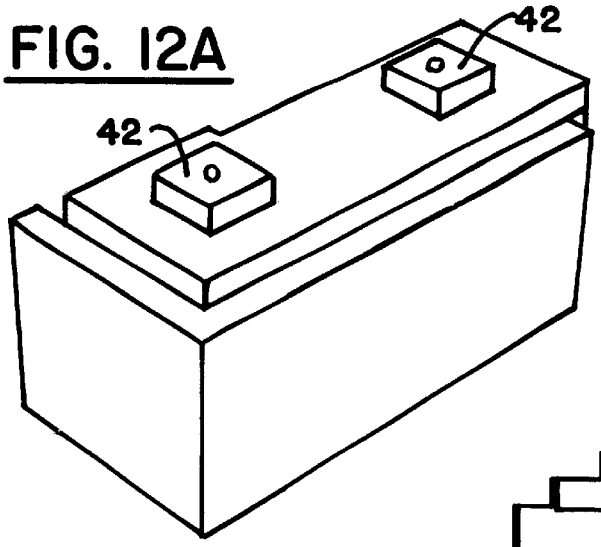
FIG. 12B
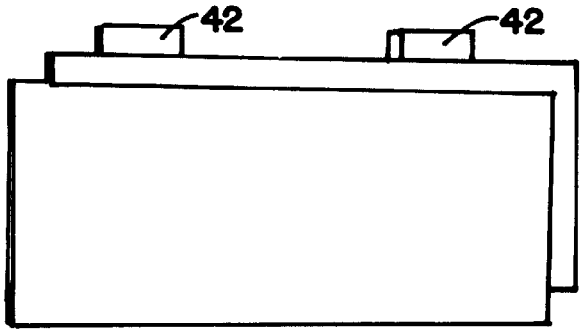
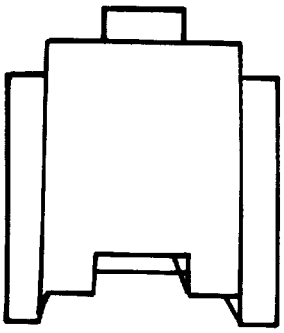
FIG. 12B
FIG. 12D
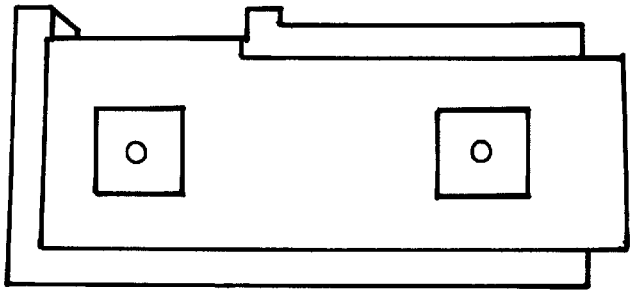
FIG. 12E
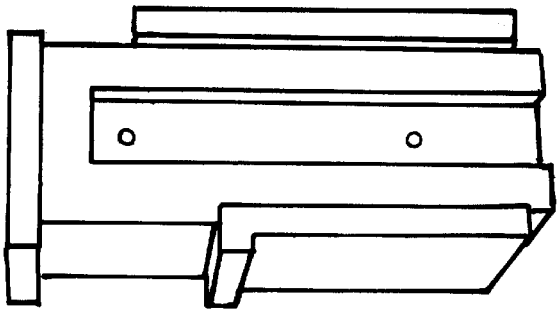

FLEXIBLE INTERLOCKING WALL SYSTEM

This is a continuation-in-part of U.S. patent application Ser. No. 08/925,311, filed Sep. 8, 1997 now U.S. Pat. No. 5,899,040, now allowed.

FIELD OF INVENTION

This present invention relates to an improvement in free-standing mortarless building structures and, in particularly, to a virtually mortarless interconnecting block system with unique dynamic properties.

BACKGROUND OF THE INVENTION

Typically speaking, free-standing masonry walls are constructed of concrete blocks (or similar material) in running courses. Each course is placed in such a manner so that the vertical joints are staggered from the previous course. Mortar is used as a binding agent between the courses and between the ends of each of the blocks. Conventional concrete blocks typically have one or more voids extending through them in the vertical direction to create vertical columns through the walls. Reinforcing bars are placed in these columns for enclosure within a continuous mortar masses within the columns, in accordance with building code standards. Such columns typically are placed approximately four feet apart along the length of the wall.

Although this type of free-standing masonry wall has been used successfully in residential, commercial and industrial construction, it possesses a considerable number of drawbacks. These include: the necessity of skilled labor for assembly (not handyman friendly), the requirement of mortar as a binding agent between each of the components, the considerable time demanded for construction, the inability to disassemble components and reuse if desired, the incapacity to absorb external pressure changes (such as settling, hydrostatic pressure and seismic disturbances) without significant deterioration to the structural integrity.

Several types of blocks and wall systems have been proposed to overcome some of these deficiencies. Beginning in 1901, U.S. Pat. No. 676,803 to Shaw, disclosed an interlocking block system that employed a combination of tongues and groves along with dovetails to secure each block to the adjacent blocks. This was followed by similar designs in U.S. Pat. Nos. 690,811 to Waller, 748,603 to Henry; 868,838 to Brewington; 1,562,728 to Albrecht; 2,902,853 Loftstrom ; and, French Patent No. 1,293,147. Although the use of interlocking male and female dovetails provide a positive lock and represent a significant improvement over similar tongue and grove construction, all of the dovetails used in this conventional art embody a critical disadvantage in terms of assembly. When these are employed (as in the case of: U.S. Pat. No. 676,803; French Patent No.1,293,147; U.S. Pat. Nos. 748,603; 1,562,728; and, 2,902,853) on the upper and lower surfaces of the block, the female dovetail of each new block must be slid over a number of male dovetails on the lower course into the appropriate position. Given the dimensional inaccuracies of common block material along with the tolerances necessary to slide the new block into place, binding is a frequent occurrence. Despite a long-felt but unresolved need for handyman friendly construction material, this frequent assembly problem, along with the various proprietary components, kept assembly to skilled professionals.

While much of the conventional art, to a certain degree, overcomes some of the difficulties associated with the requirement of mortar, and the inability to disassemble, none provide for the capacity to automatically absorb external pressure changes without significant deterioration in structural integrity.

Attempts to address this particular problem have come in the form of steel reinforcement of some kind. In 1907, U.S. Pat. No. 859,663 to Jackson employed steel post, tension-threaded reinforcement rods in combination with steel frames to produce a very strong wall. The use of steel post, tension-threaded reinforcement rods can also be seen in: U.S. Pat. Nos. 3,378,96 to Larger; 859,663 to Jackson; 4,726,567 to Greenburg; 5,138,808 to Bengtson et al.; and, 5,355,647 to Johnson et al.

Unfortunately, this move to steel reinforcement as a means to counter external pressure meant the loss of many of the gains achieved by much of the conventional art. In short, the characteristics of: mortarless construction and the ability to disassemble components and reuse them were sacrificed for a stronger wall.

Although the addition of steel to bind the wall in a solid mass contributed to it structural integrity by better resisting certain external forces, this is only true in the case of a force applied in one direction against the wall. As in the case of hydrostatic pressure, the force moves only in one direction; from the outside to the inside, slowly and steadily. Seismic disturbances, such as those associate with earthquakes, tend to move the earth in a rapid back and forth motion. A wall bound as a sold mass is unable to accommodate the dynamic back and forth movement. Instead, its rigid composition directly transfers the force to the rest of the building (acting as sort of a lever) weakening the integrity of the entire structure until it finally fails.

Thus, it is desirable to provide a masonry wall system that incorporates the advantages of: unskilled labor for assembly; mortarless construction; the ability to disassemble and reuse; and, the necessary capacity to automatically absorb external pressure changes (particularly seismic disturbances) without significant deterioration of structural integrity. Such a wall system would create a new synergy that would satisfy a long-felt but unresolved need. It would also represent a positive contribution to the masonry industry.

SUMMARY OF THE INVENTION

Accordingly it is an object of the present invention to provide an improved masonry walls system that does not require skilled labor to assemble.

It is another object of the present invention to provide a masonry wall system that does not require mortar for it's construction.

It is a further object of the present invention to provide an improved masonry wall system that is capable of rapid, on-site assembly.

It is still another object of the present invention to provide an improve masonry wall system that can be disassembled and then reused.

It is still an additional object of the present invention to provide an improved masonry wall system that overcomes the conventional problems of masonry assembly in which dovetail structures are used.

It is yet another object of the present invention to provide an improved masonry wall system that is capable of absorbing external pressure changes (such as settling, hydrostatic pressure and seismic disturbances) without significant deterioration in the structural integrity of the wall system.

It is yet a further object of the present invention to provide an improved masonry wall system that is capable of distributing stress on any portion of the wall throughout a large surrounding segment of the wall.

It is again another object of the present invention to provide an improved masonry wall system having a wide variety of interlocking schemes to facilitate flexibility in wall design and construction.

It is still a further object of the present invention to provide an improved masonry wall system that has superior earthquake-resistant properties to conventional masonry wall systems.

It is yet a further object of the present invention to provide a model system for an improved, mortarless wall system.

It is again another object of the present invention to provide a mortarless masonry wall system in which no vertical seams between adjacent blocks are lined from row to row, thereby strengthening the wall system.

These and other objects and goals of the present invention are achieved by an interlocking mortarless wall system having at least two major surfaces, each major surface forming a wall face. This system includes a plurality of main blocks, each main block being constituted by at least one stabilizing hole, positioned to be vertically co-linear with stabilizing holes in other blocks when positioned with respect to each other in an interlocking configuration to form a wall face. Each main block includes an upper interlocking device for interlocking with vertically adjacent blocks, and a lower interlocking device for interlocking with vertically adjacent blocks. A plurality of reinforcing structures are placed in the stabilization holes through a plurality of the main blocks. Each of the reinforcing structures is sized to permit movement of the main blocks along horizontal planes for a predetermined extent in a direction perpendicular to at least one of the wall faces. As a result, the horizontal movement to the predetermined extent transfers stress to adjacent blocks.

In another embodiment of the present invention an interlocking mortarless wall system has two major surfaces each forming a wall face. The system is constituted by a plurality of interlocking blocks arranged to form the wall face. The system has a device for transferring stress between the blocks. As a result, stress on a first block facilitates movement of the block in a direction perpendicular to the wall face. Locking the adjacent vertical blocks at a predetermined extent of block movement allows the wall system to remain stable.

BRIEF DESCRIPTION OF THE DRAWINGS

FIG. 1(*b*) is a perspective diagram depicting the rear view of the block of FIG. 1(*a*).

FIG. 3 is a perspective diagram depicting a corner block.

FIG. 4 is a perspective diagram depicting a short block.

FIG. 5 is a perspective diagram depicting a partially assembled wall using the inventive system.

FIG. 6 is a top view of the first course of a wall constructed according to the present invention.

FIG. 11(*a*) is a perspective view of a main block used in another embodiment of the present invention.

FIG. 11(*b*) is a bottom view of the block of FIG. 11(*a*).

FIG. 11(*c*) is a top view of the block of FIG. 11(*a*).

FIG. 11(*d*) is an end view of another variation of the present invention.

FIG. 11(*e*) is an end view of still another variation of the present invention.

FIG. 12(*a*) is a perspective view of a corner block used in further embodiment of the present invention.

FIG. 12(*b*) is a front view of the corner block of FIG. 12(*a*).

FIG. 12(*c*) is a first end view of the corner block of FIG. 12(*a*).

FIG. 12(*d*) is a top view of the corner block of FIG. 12(*a*).

FIG. 12(*e*) is a bottom view of the corner block of FIG. 12(*a*).

FIG. 13(*b*) is a first end view of the corner block of FIG. 13(*a*).

FIG. 13(*c*) is a first side view of the corner block of FIG. 13(*a*).

FIG. 13(*d*) is a top perspective view of the corner block of FIG. 13(*a*).

FIG. 13(*e*) is a bottom perspective view of the corner block of FIG. 13(*a*).

DETAILED DESCRIPTION OF THE PREFERRED EMBODIMENTS

Figure 1A:
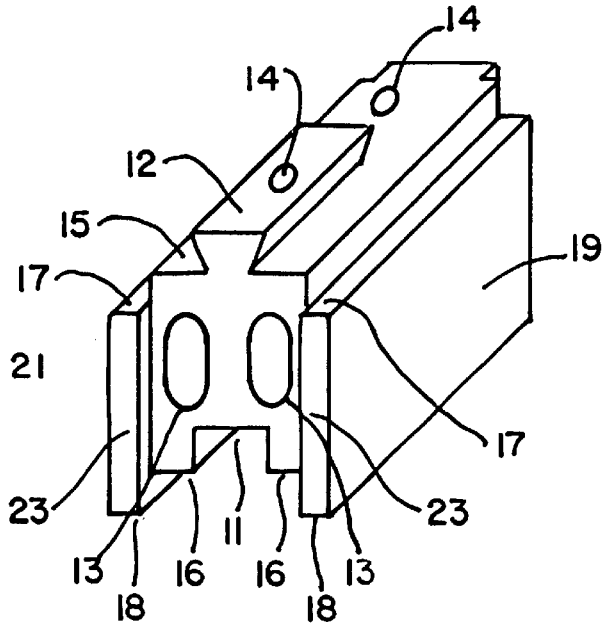
FIG. 1(*a*) is a perspective diagram depicting the main block component of the inventive wall system.
Figure 1B:
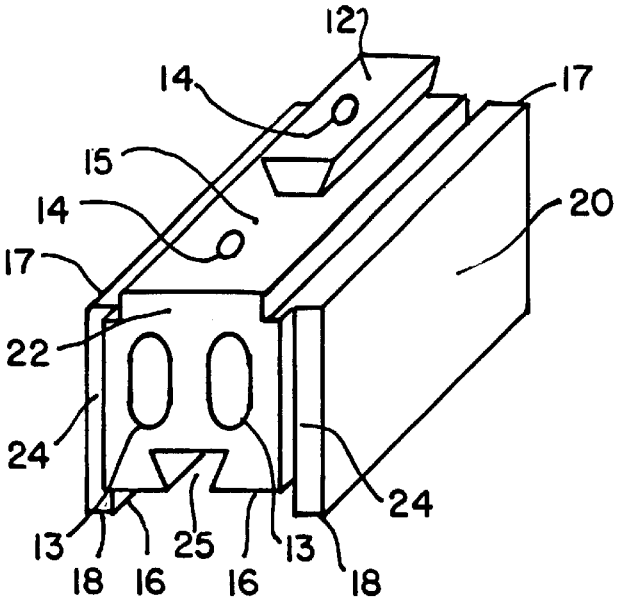

FIGS. 1(*a*) and 1(*b*) depict two perspective views of the main block constituting the present invention. The drawing designation numerals included in FIGS. 1(*a*) and 1(*b*) remain the same for all of FIGS. 1(*a*)–10. For the sake of clarity and efficient consideration of all of the drawings, the legend of the drawing designation numerals is provided below:

| | |
|---|---|
| 11. square receiving slot | 21. front plane |
| 12. dovetail | 22. rear plane |
| 13. through holes | 23. front shoulder |
| 14. stabilizing holes | 24. rear shoulder |
| 15. upper plane | 25. dovetail receiving slot |
| 16. lower plane | 26. corner block |
| 17. upper shoulder | 27. cynderbrick (main block) |
| 18. lower shoulder | 28. short block |
| 19. interior sides | 29. footer |
| 20. exterior sides | 30. foundation |

The wall system of the present invention is essentially composed of three basic components. These include: a main block, a corner block, and short block. The main block, shown in FIGS. 1(*a*) (front view) and 1(*b*) (rear view), is the fundamental component upon which the entire wall system is based. It is rectangular in its general shape and possess a number of crucial features that set it apart from the conventional art. Situated on the upper plane 15 is a male dovetail 12 extending up from the front plane 21 and back to approximately one-half the length of the cynderbrick. Running along the lower plane 16, parallel to the male dovetail 12 on the upper plane 15, is the combination square receiving slot 11 and dovetail receiving slot 25. The square receiving slot 11 runs approximately one-half half the length from the front plane 21 and then gradually turns into the dovetail receiving slot 25.

This feature enables a new main block to be placed directly over the top of a main block on the lower course. Here, the square receiving slot 11 of the main block freely receives the dovetail 12 of the main block on the lower course. The new main block is then slid one-half its length so that, as the square receiving slot 11 turns into dovetail receiving slot 25 on the new main block, it engages the male dovetail 12 on the main block on the lower course and is locked into position staggering the vertical joints. This feature overcomes the assembly difficulties found in prior art where each new block must be slid over a number of other blocks on the lower course into the appropriate position. It is also easier to fit the blocks of the present invention onto other such blocks than with similar conventional art interlocking wall systems. This is due to the fact that the tolerances between the dovetails and the dovetail slots of the present invention are quite large so that there is easy assembly. The use of large tolerances between the interlocking pieces has benefits that are explained infra. On the other hand, in conventional interlocking wall systems, the tolerances between the slots and pieces that are meant to extend into the slots are quite small. The resulting tight fits are necessary for the proper assembly of such conventional art walls but make the assembly quite difficult. This drawback is not shared by the system of the present invention.

Figure 8:
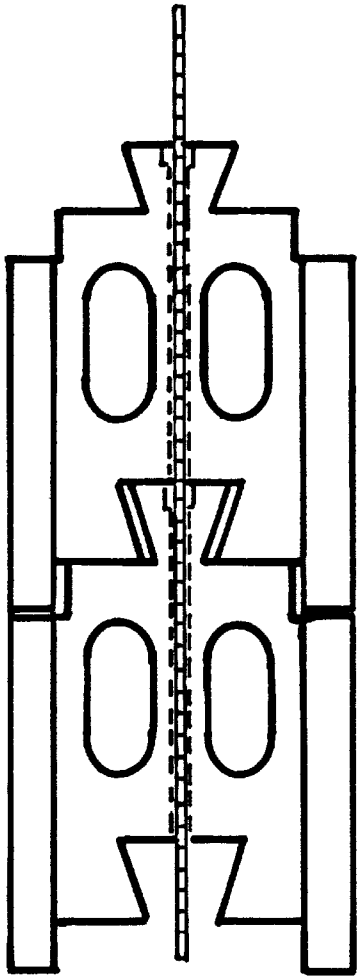
FIG. 8 is a cross sectional view of the structure of FIG. 7 under different external conditions.
Figure 7:
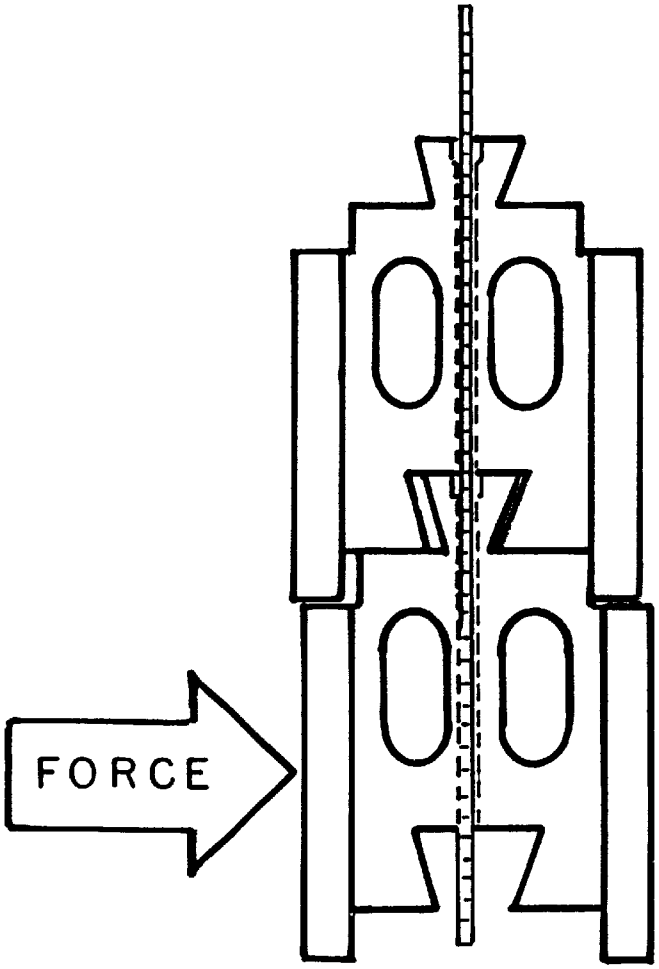
FIG. 7 is a cross sectional view of a portion of a wall assembled according to the present invention, under 1 set of external conditions.
Figure 9:
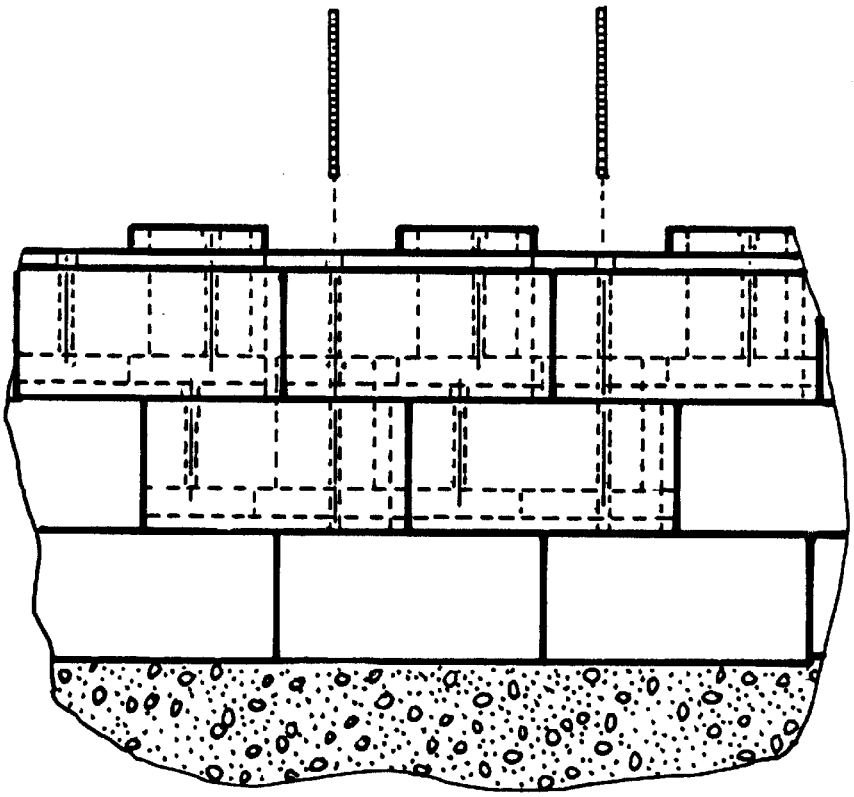
FIG. 9 is an elevation view of the wall according to the present invention, depicting placement of reinforcement rods.

The sides of the main block 19, 20 are off-set (in a parallel manner) both horizontally and vertically creating interlocking shoulders 17, 18, 23, 24 when mated to adjacent blocks. This provides the blocks with horizontal and vertical stability. The lower shoulder 18 also acts as a drip edge resisting water penetration. Running at a vertical axis through the center of the main block are two stabilizing holes 14. These hole loosely accommodate either steel reinforcement rods or square tubing as shown in FIGS. 7, 8 and 9. Optional through holes 13 may be added to reduce the amount of cement and/or other material used to manufacture the component.

Figure 2:
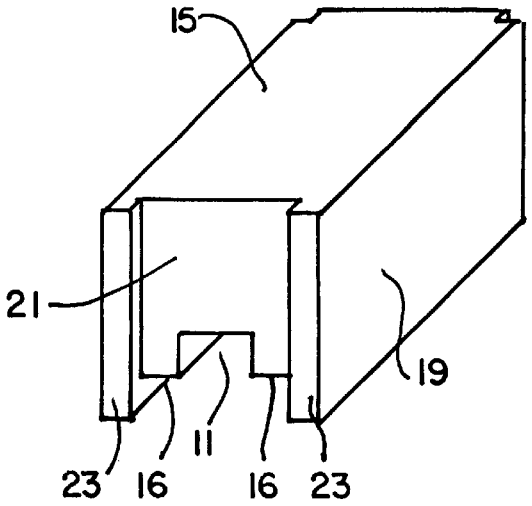
FIG. 2 is a perspective diagram depicting a sill cap.

Both the corner block shown in FIG. 3 and the short block shown in FIG. 4 employ the same features as the main block with the exception of the interlocking dovetail. The interconnection of these components is illustrated in FIGS. 5 and 6. A sill cap, as depicted in FIG. 2 is employed over the top of the last course to help lock the course of blocks into place, and to provide a surface for subsequent framing if required.

While the aforementioned blocks may appear similar to those found in the conventional art examples, the differences that have been pointed out are very significant with respect to the manner in which the wall operates to distribute external stress. While all interlocking blocks possess some play by virtue of the tolerances necessary to interconnect them, none possess the attribute of variable dynamic resistance. The term, dynamic resistance, can be defined as the property of a structure to slightly give under pressure and then lock up as a solid mass at a given point. Thus, variable dynamic resistance is dynamic resistance that can adjusted to suit construction and environmental requirements.

The operation of this property is effected by a combination of block fit tolerances and the use of either steel reinforcement rods or square tubing loosely placed through the stabilizing holes 14 at the top. By changing the number of rods and their placement, a considerable degree of variation can be achieved. Simply put, more rods in more places means less fluidity and more rigidity. Conversely, fewer rods in fewer places means more fluidity and less rigidity. This property substantially increases wall integrity and reduces the common cracking found in contemporary wall construction. Also, the tolerance between the stabilizing hold and the forcing rods can also be adjusted to adjust the degree of wall movement permitted.

Figure 10:
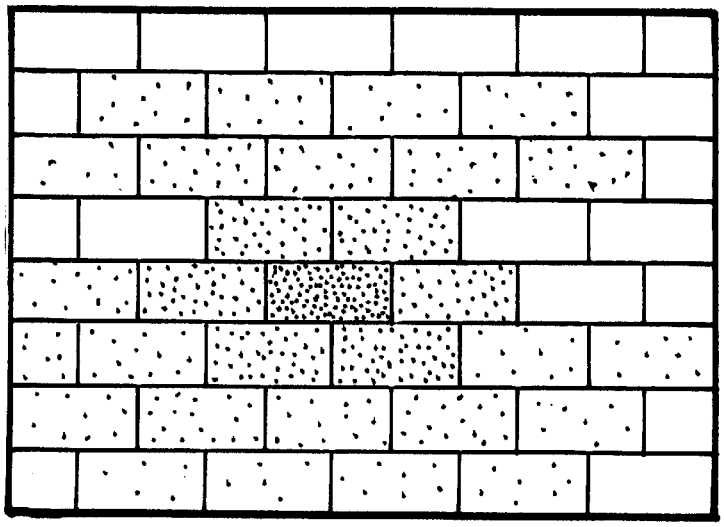
FIG. 10 is an elevation view depicting the distribution of force on a wall according to the present invention.
Figure 13A:
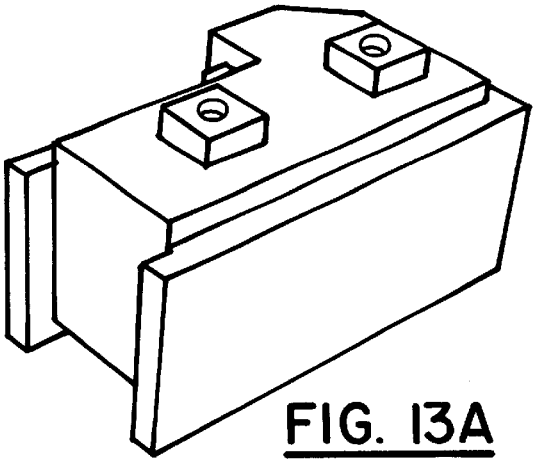
FIG. 13(*a*) is a perspective view of a corner block of another embodiment of the present invention.
Figure 13B:
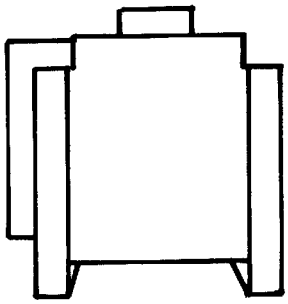
Figure 13C:
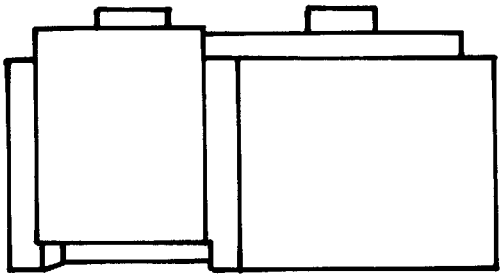
Figure 13D:
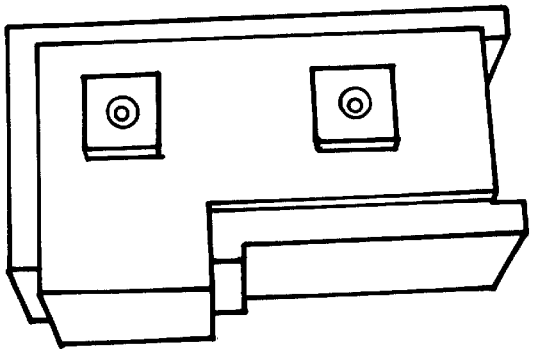
Figure 13E:
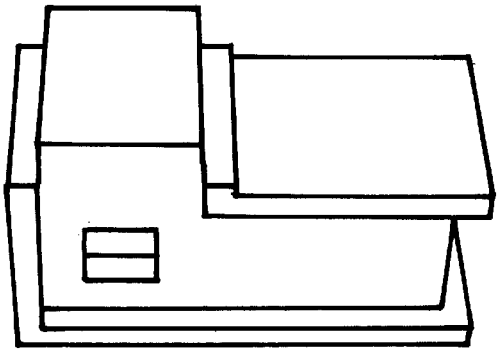

When forces such as hydrostatic pressure are exerted against the wall surfaces, each cynderbrick moves slightly. The first movement occurs proximate to the pressure. As this block moves to its predetermined tolerance (when the dovetail jambs against the side of the slot and the reinforcing rod jambs against the side of the whole containing it), it automatically locks in place and then transfers this force to the six adjacent blocks (two top, two bottom and two sides, see FIG. 10). These blocks likewise move a predetermined extent until they reach the end of their tolerance and then they, in turn, transfer the force to the other adjoining blocks. This allows the entire wall to progressively and systematically absorb the force moving gradually as it does. This radial transfer is illustrated in FIG. 10 where the darkers represent the greater degree of stress and earlier lock-up in the progression.

Strategically placed within the wall are either steel reinforcement rods or square tubing as seen in FIG. 9. These run in a vertical fashion and are used to stabilize the wall when it reaches the end of its tolerance and locks up. Unlike all of the conventional art, the steel reinforcement rods or square tubing are loosely placed with the vertical holes as depicted in FIG. 8. This space between the hole and the reinforcing rod (along with the tolerance between the block dovetails and their associated slots) permit movement of the wall up to a point. This is when the side of the dovetail jambs tight against the side of it's respective slot and the reinforcing rod jambs tightly against the hole through which it is placed. Thus, these elements act in conjunction to provide controlled movement and positive lock-up.

When the wall is in locked-up state, all of the blocks have reached the end of their predetermined tolerances and the force is now transferred to either the steel reinforcement rods or the square tubing as shown in FIG. 7. This transfer is possible because the space between the steel reinforcement rods and the vertical holes in the cynderbricks are reduced as a result of the block movement up to this point. The reinforcing rods now act to stabilizing the structure. This, in turn, further limits the movement of the wall and positively acts to resist the applied pressure. Because of the interlocking dovetails and the manner in which the horizontal and vertical surfaces connect, each block contributes to resist the force. Thus, the present structure operates to distribute the force on any particular block or blocks, as depicted in FIG. 10. As a result, instead of all the force being placed upon the block (depicted as the darkest block in FIG. 10), the force is distributed to surrounding blocks and in diminishing measure to those blocks surrounding them. By spreading the force as depicted in FIG. 10, it is far less likely that sufficient stress will be built up on one block or group of blocks to cause the wall to fail at a particular point. This makes the wall a strong interconnected mass able to withstand far more force than its traditional counterparts.

There are five factors that contribute to the property of variable dynamic resistance. These can be divided into two general categories: fixed and variable. The fixed factors are those designed within the system and cannot be altered unless the dimensions are modified. These include the overall size of the cynderbrick, the tolerance between each cynderbrick and the size of the stabilizing holes. The variable factors are those that can be adjusted by the assembler.

Among these are: the number and placement of the either the steel reinforcement rods or the square tubing.

The unique physical characteristics of the masonry components, working in conjunction with the loosely placed rods/tubing, produces the highly efficient distribution of force over a large segment of the wall, enabling the wall not only to accommodate gradual directional forces such as settling and hydrostatic pressure, but rapid omnidirectional forces such as seismic disturbances. The wall structure which facilitates the property of variable dynamic resistance, creates a technique for dealing with omnidirectional external pressures.

The flexible walls of the present invention can accommodate the movements found in earthquake zones. In contrast, the rigid conventional walls, such as those found in residential foundations, will directly transfer the seismic force to the rest of the building cumulatively weakening the integrity of the structure until it eventually fails. Not only does the present invention overcome this significant problem, but it also has the added features of:

(a) providing an improved masonry wall system that does not require skilled labor to assemble;

(b) providing an improved masonry wall system that is mortarless in construction;

(c) providing an improved masonry wall system with rapid on-site assembly;

(d) providing an improved masonry wall system that can be disassembled and reused;

(e) providing an improved masonry wall system that overcomes the problems commonly associated with dovetail assemble.

It will be understood by one skilled in this art that any number of different configurations of front shoulders, rear shoulders, upper shoulders and lower shoulders (17,18,23, 24), as well as other related interlocking structures can be used within the scope of the present invention. Further, any combination of square receiving slots 11 (in FIG. 11(*e*)) and dovetail receiving slots 25 can be used. One example is found in FIG. 11(*d*) which depicts the combination of a square slot for easy fitting of two adjacent blocks and a dovetail receiving slot 25 to more closely hold the two adjacent blocks together.

The embodiment of FIGS. 11(*a*)–11(*d*) differs from that previously described by virtue of a second receiving aperture 41, which is designed to hold an upper connecting stud 42 such as that depicted in FIG. 12(*a*). The embodiment of FIG. 11(*a*) can include dovetail 12 as an upper interlocking device, or can use a rectangular structure as in FIG. 11(*e*) in lieu of the dovetail.

FIGS. 12(*a*)–12(*e*), as well as FIGS. 13(*a*)–13(*e*) depict two additional embodiments of the present invention. All of the blocks depicted in these drawings are corner blocks. The blocks of FIGS. 12(*a*)–12(*e*) and those of FIGS. 13(*a*)–13(*e*) are meant to alternate with each other so as to create a staggered vertical seam at the interface of the corner blocks and the main blocks.

An alternative to dovetail 12 or a rectangular key structure, interconnecting studs 42 (as depicted in FIG. 12(*a*)) can be substituted. Either one such stud or two, as depicted in the drawings can be used where appropriate. The use of the connecting studs rather than the elongated dovetail structure or elongated dove structure can often make assembly of the blocks easier. This can be especially important when trying to alternate between different types of corner blocks (such as those depicted in FIGS. 12(*a*)–12(*e*) and 13(*a*)–13(*e*)) in order to avoid a vertical seam line on either side of the corner blocks. The avoidance of this seam line is especially important in further strengthening the wall system.

It should be evident to one skilled in this art that virtually any configuration of wall block can be used within the concept of the present invention in order to provide the desired configuration of the various blocks depicted in the drawings, as well as those having other interlocking configurations that would occur to one skilled in this art.

The blocks can be made of any masonry material including cellular concrete or other light weight materials such as the auto-clave, aerated concrete used in many structural materials. This will allow the system of the present invention to be used in a wide variety of different structural applications.

Further, the blocks used in the present invention can be molded or otherwise formed to include conduit runs, ventilation connections or any other configuration to accommodate other building materials to be used with the wall system. Consequently, the wall system of the present invention can be configured to accommodate all of the structures that might be used as part of a building which includes the present invention. Such formations can also include aesthetic features, such as colors, different textures for the surface of the wall, and even base-relief designs.

Because the concept of the present invention can be carried out using a number of different materials for the blocks, the wall system of the present invention can be down-scaled to be used for modeling purposes, or even as toys. Accordingly, the materials used to manufacture the blocks are to be of sufficient density to accommodate the various shapes of the blocks on a scale appropriate for toys or models. While even cellular concrete may not be appropriate for this application, other materials can be used. For example, plastic, rubber or even wood can be used to duplicate the inventive wall system for purposes of creating working models or toys.

When the present invention is used in a model or toy application, the reinforcing rods depicted in FIGS. 7 and 8 can be made of a number of different materials since structural steel would not be required for such applications. For example, the rods can be made of elongated plastic or rubber. In order to simulate the actual variable dynamic resistance of the present invention, the rods are preferably made of a flexible metal material, even for modeling or toy applications.

The reenforcing rods can be further made more effective and hold the wall system together more throughly from top to bottom if the rods are threaded at both ends (not shown). This would allow the lower part of the rod to be threaded into a threaded receiving piece formed into the concrete foundation (not shown). The upper end of the reenforcing rod would also be threaded to allow a nut to hold a plate (not shown) to the top of the wall. Such an arrangement would make the wall system more able to withstand the stresses caused by earthquakes and other massive disruptions. The tightness of the bolted plates at the top of the wall should be adjusted depending upon the amount of movement that would be considered desirable for the wall system.

Further stability could be obtained by forming a templet (preferably of masonry material) as part of the foundation on which the wall of the present invention would be placed. Such a templet could have the configuration of upper interlocking structures depicted in the drawings. Such interlocking structures on the templet would interlock with the lower interlocking structures of the first row of blocks of the wall, thereby forming a more stable structure. In the alternative, such a templet could be formed separately, and include only as much material as is necessary for the basic interlocking between adjacent blocks. Such a templet could be bolted directly to the foundation in a manner well known to those skilled in the art so that the first course of full blocks would be interlocked onto the templet. To facilitate ease of installation and flexibility in assembling the wall system, the templet could be made of a number of materials other than the masonry used to form the main part of the wall system. For example, the templet could be made of metal (preferably rust-resistant), hard rubber, nylon, plastic, or even pressure-treated wood.

Although the above description contains many specific details, these should not be construed as limiting the scope of the present invention but as merely providing illustrations of some of the presently preferred embodiments of the invention. Accordingly, the present invention should be considered to include any and all variations, permutations, modifications and adaptations that would occur to any skilled practitioner that has been taught to practice the present invention. For example, it is envisioned that other components using the same features may be added later such as: partition blocks, end caps and lintels. Thus, the scope of the invention should be limited only by the appended claims and their legal equivalents, rather than the examples given herein.

I claim:

1. An interlocking, mortarless wall system having at least two major surfaces, each major surface forming a wall face, said system, comprising:

(a) a plurality of main blocks, each main block comprising
  (i) at least one stabilizing hole, said stabilizing hole positioned to be vertically co-linear with stabilizing holes in other blocks when positioned with respect to each other in an interlocking configuration to form a wall face,
  (ii) upper interlocking means for interlocking with vertically adjacent blocks;
  (iii) lower interlocking means for interlocking with vertically adjacent blocks; and, (b) a plurality of reinforcing structures placed in said stabilization holes through a plurality of said main blocks, each said reinforcing structure is being sized to permit movement of said main blocks along at least one horizontal plane for a predetermined extent in a direction perpendicular to at least one said wall faces, whereby horizontal movement to said predetermined extent transfers stress to adjacent blocks causing limited block movement to adjacent blocks.

2. The system of claim 1, wherein said upper interlocking means comprise at least one rectangular stud.

3. The system of claim 2, wherein said lower interlocking means comprise at least one aperture corresponding to said upper interlocking means.

4. The system of claim 3, further comprising a masonry footer upon which said main blocks are placed.

5. The system of claim 4, further comprising a template connected to said footer, and configured to have a structure corresponding said upper interlocking means and arranged to interface with said lower interlocking means of a row of blocks to be placed on said template.

6. The system of claim 5, wherein said main blocks further comprise lateral connecting means corresponding to lateral connecting means of adjacent blocks.

7. The system of claim 6, wherein said reenforcing means comprise at least one elongated steel rod.

8. The system of claim 7, wherein each end of said elongated steel rods is threaded, facilitating a variable level of pressure on said wall system between said footer and a top row of blocks.

9. The system of claim 8, further comprising at least one top plate arranged to be connected to said wall system by virtue of said upper thread and said elongated rod structure.

10. The wall system of claim 1, wherein said wall system is configured and sized as a model.

11. The wall system of claim 10, wherein said wall system is made of a material selected from a group consisting of plastic, wood, rubber, metal, clay.

12. The wall system of claim 9, further comprising a plurality of corner blocks, each having two lateral end surfaces, said corner blocks being arranged vertically so that no two adjacent corner blocks have lateral end surfaces that align with each other.

13. An interlocking mortarless wall system having at least two major surfaces, comprising:

(a) a plurality of interlocking blocks forming said wall faces; and, (b) means for transferring stress on a first block thereby facilitating movement of blocks in a direction perpendicular to said wall face and locking of adjacent vertical blocks at a predetermined extent of movement.

14. The wall system of claim 13, wherein said means for transferring stress comprise elongated steel rods placed in a plurality of aligned vertical holes in said blocks.

15. The wall system of claim 14, wherein said predetermined extent of movement is determined by spacing between said vertical holes and said elongated steel rods.

* * * * *